US006267284B1

(12) United States Patent
Clark

(10) Patent No.: US 6,267,284 B1
(45) Date of Patent: Jul. 31, 2001

(54) POWER ACTUATED TOOLS WITH MAGAZINE FEED

(75) Inventor: Philip Charles Clark, Vermont South (AU)

(73) Assignee: Ramset Fasteners (Aust.) Pty. Limited, Croydon North (AU)

( * ) Notice: Subject to any disclaimer, the term of this patent is extended or adjusted under 35 U.S.C. 154(b) by 0 days.

(21) Appl. No.: 09/397,470

(22) Filed: Sep. 17, 1999

(30) Foreign Application Priority Data

Sep. 18, 1998 (AU) ..... PP 6028
Nov. 23, 1998 (AU) ..... PP 7252

(51) Int. Cl.[7] ..... B25C 1/04

(52) U.S. Cl. ..... 227/8; 227/119; 227/120; 227/136

(58) Field of Search ..... 227/119, 8–10, 227/128, 136, 120, 127, 135; 60/634, 636

(56) References Cited

U.S. PATENT DOCUMENTS 3,606,128 * 9/1971 Cast et al. ..... 227/8
3,670,942 * 6/1972 Pomeroy ..... 227/10
4,715,522 * 12/1987 Jordan ..... 227/120
4,732,309 * 3/1988 Judge ..... 227/128
4,809,898 * 3/1989 Gassner et al. ..... 227/8
4,930,673 * 6/1990 Pfister ..... 227/10
4,932,580 * 6/1990 Pfister et al. ..... 227/10
5,167,359 * 12/1992 Frommelt ..... 227/8
5,220,123 * 6/1993 Oehry ..... 227/10
5,597,972 * 1/1997 Wachter ..... 227/10
5,683,024 * 11/1997 Eminger et al. ..... 227/8
5,687,898 * 11/1997 Toulouse ..... 227/8
5,829,661 * 11/1998 Hirtl et al. ..... 227/10
6,036,072 * 3/2000 Lee ..... 227/120

* cited by examiner

*Primary Examiner*—Scott A. Smith
(74) *Attorney, Agent, or Firm*—Knobbe, Martens, Olson & Bear, LLP

(57) ABSTRACT

A power actuated tool for driving a fastener such as a pin or nail into a substrate, has a fastener guide mounted at the forward end of a body of the tool for displacement axially inwardly relative to the body when the forward end of the tool is pressed against a substrate whereby to permit firing of the tool. A magazine carried by the tool for containing a plurality of fasteners mounted seriatim on segments of a carrier strip advances the leading end of the carrier strip and the fastener carried thereby into the fastener guide. A locking system for impeding firing of the tool is releasable in response to the presence of a fastener and associated segment of the carrier strip within the fastener guide whereby to permit firing of the tool only when a fastener is present within the fastener guide. The locking system thereby acts to prevent firing of the tool when the magazine is empty of fasteners and which could otherwise lead to damage occurring to the tool.

8 Claims, 6 Drawing Sheets

POWER ACTUATED TOOLS WITH MAGAZINE FEED

BACKGROUND OF THE INVENTION

1. Field of the Invention

The present invention relates to power actuated tools for driving fasteners into a substrate and particularly to such tools which operate by detonation of an explosive charge. More particularly the invention relates to power actuated tools in which the fastener such as a nail or pin is fed from a magazine into the tool. The invention also relates to a fastener such as carrier strip for use in such a tool.

2. Description of the Prior Art

Power actuated tools for driving fasteners such as nails or pins into a substrate such as a concrete or steel beam conventionally comprise a barrel from which the fastener is expelled by means of a piston driven by detonation of an explosive charge. Previously proposed tools of this type are described for example in our International patent applications Nos. PCT/AU98/00255 and PCT/AU90/00018 the disclosure of which is hereby incorporated by reference. Tools of the type described in our aforesaid applications are principally designed for use with a single fastener which is loaded manually into the front of the barrel for subsequent discharge when the forward end of the barrel is pressed against the surface to cock the tool to permit firing of the explosive charge upon actuation.

There is now an increasing demand for explosively actuated tools in which the fasteners are loaded automatically or semi-automatically from a magazine. In certain previously proposed tools with magazine feed, the magazine is carried by the body of the tool at the forward end thereof and fasteners are mounted seriatim on successive segments of a carrier strip housed within the magazine. The endmost fastener on the carrier strip is located within an axially displaceable fastener guide which forms an extension of the barrel of the tool, with the tool being cocked for subsequent firing when the forward end of the fastener guide is pressed against the substrate and displaced rearwardly relative to the body of the tool. A practical difficulty with a magazine fed tool is that an operator might not always be aware the supply of fasteners from the magazine has been used and accordingly may be unaware that there is no fastener loaded within the fastener guide. If the tool is fired under these circumstances, the driving piston will be under full power when it strikes an appropriate stop at the forward end of the barrel and which is likely to result in damage to the piston, the barrel, and possibly associated components.

SUMMARY OF THE INVENTION

According to one aspect of the present invention, there is provided a power actuated tool for driving a fastener such as a pin or nail into a substrate, said tool comprising a body, a fastener guide mounted at the forward end of the body, said fastener guide being displaceable axially inwardly relative to the body when the forward end of the tool is pressed against a substrate whereby to permit firing of the tool, a magazine carried by the tool for containing a plurality of fasteners mounted seriatim on segments of a carrier strip, said magazine including means for advancing the leading end of the carrier strip and the fastener carried thereby into the fastener guide, and releasable locking means for impeding firing of the tool, said locking means being releasable in response to the presence of a fastener and associated segment of the carrier strip within the fastener guide whereby to permit firing of the tool only when a fastener is present within the fastener guide.

In a preferred embodiment of the invention, the locking means is operative to restrain the fastener guide against axial inwards movement relative to the body at least to an extent sufficient to permit firing of the tool.

Preferably the locking means is released by force exerted on the locking means by the force exerted on the carrier strip by the advancing means.

Advantageously, the locking means is released by force applied to the locking means via the carrier strip segment within the fastener guide.

In a preferred embodiment, the locking means comprises a locking member which is displaceable by engagement with the carrier strip segment within the fastener guide so as to permit inwards axial displacement of the fastener guide. Preferably, the locking member includes a cam which projects into the interior of the fastener guide so as to be engageable by the carrier strip segment within the guide to permit release of the locking member by an extent sufficient to enable some axial inwards movement of the fastener guide, the tool including means operative upon axial movement of the fastener guide with the locking means in its released position to effect further movement of the locking member sufficient to ensure that the cam is clear of the inner surface of the fastener guide so as to prevent contact with the head of the fastener and/or driving piston of the tool when the tool is fired.

A difficulty which may arise with a magazine-fed tool as described above concerns the proper location of the final fastener of the carrier strip within the fastener guide.

With the exception of the final fastener, each successive fastener fed into the fastener guide by the carrier strip will automatically be located in the correct position and orientation within the fastener guide due to the support provided by the following segments of the carrier strip still located within the magazine. However no such guidance will be provided for the final fastener and its associated segment of the carrier strip which will be completely removed from the magazine and within the fastener guide.

Therefore, according to another aspect of the invention, there is provided a carrier strip for use with a tool as defined above, said carrier strip comprising a plurality of carrier segments arranged seriatim, each carrier segment having means operable to retain a fastener so that the fasteners are retained within the carrier strip in parallel arrangement and each carrier segment including means arranged to co-operate with the locking means when that carrier segment is present within the fastener guide so as to cause release of the locking means, and the final carrier segment at the trailing end of the carrier strip including locating means for ensuring that the final segment when within the fastener guide is maintained in correct condition for co-operation with the locking means.

Preferably, the final carrier segment includes locating means co-operable with the advancing means of the magazine to locate the segment in a suitable position for correct co-operation with the locking means.

Preferably, the locating means is operative to maintain the final segment in a predetermined rotational position relative to the locking means and in a predetermined axial position relative to the locking means.

The present invention also provides a carrier strip as defined above carrying fasteners for use in the tool.

According to yet another aspect of the invention, there is provided a power actuated tool for driving a fastener such as a pin or nail into a substrate, said tool comprising a body, a fastener guide mounted at the forward end of the body, said fastener guide being displaceable axially inwardly relative to the body when the forward end of the tool is pressed against the substrate whereby to permit firing of the tool, a magazine carried by the tool for containing a plurality of fasteners mounted seriatim on segments of a carrier strip, said magazine including means for advancing the leading end of the carrier strip and the fastener carried thereby into the fastener guide, a cover movable from a closed to an open condition to permit loading of a fresh carrier strip with fasteners into the magazine, and means for providing an indication of the number of fasteners remaining in the tool, said indication being observable by an operator when the cover is in its closed condition.

In a preferred embodiment indication of the number of fasteners remaining is effected by viewing from outside of the tool with the cover closed, the position of the advancing means and/or the carrier strip and/or the fasteners within the magazine.

In a particularly preferred embodiment of the invention, the advancing means comprises pusher member which engages the final carrier segment at the trailing end of the carrier strip so as to advance the leading end of the carrier strip into the fastener guide, the pusher member advancing stepwise through the magazine as each successive fastener is fired whereby the position of the pusher member within the magazine is indicative of the number of fasteners remaining in the tool. Preferably the position of the pusher member within the magazine and thus an indication of the number of fasteners remaining is effected by viewing a segment of the pusher member through an aperture or window in the cover. Alternatively, the aperture or window can enable viewing of the position of the final carrier segment (or fastener carried thereby) at the trailing end of the carrier strip. Preferably the part of the pusher member or final carrier segment which is visible through the aperture or window is distinctive in colour relative to that cover to enable an operator readily to ascertain the remaining number of fasteners.

BRIEF DESCRIPTION OF THE DRAWINGS

An embodiment of the invention will now be described, by way of example only, with reference to the accompanying drawings in which.

DESCRIPTION OF THE PREFERRED EMBODIMENT

Figure 1:
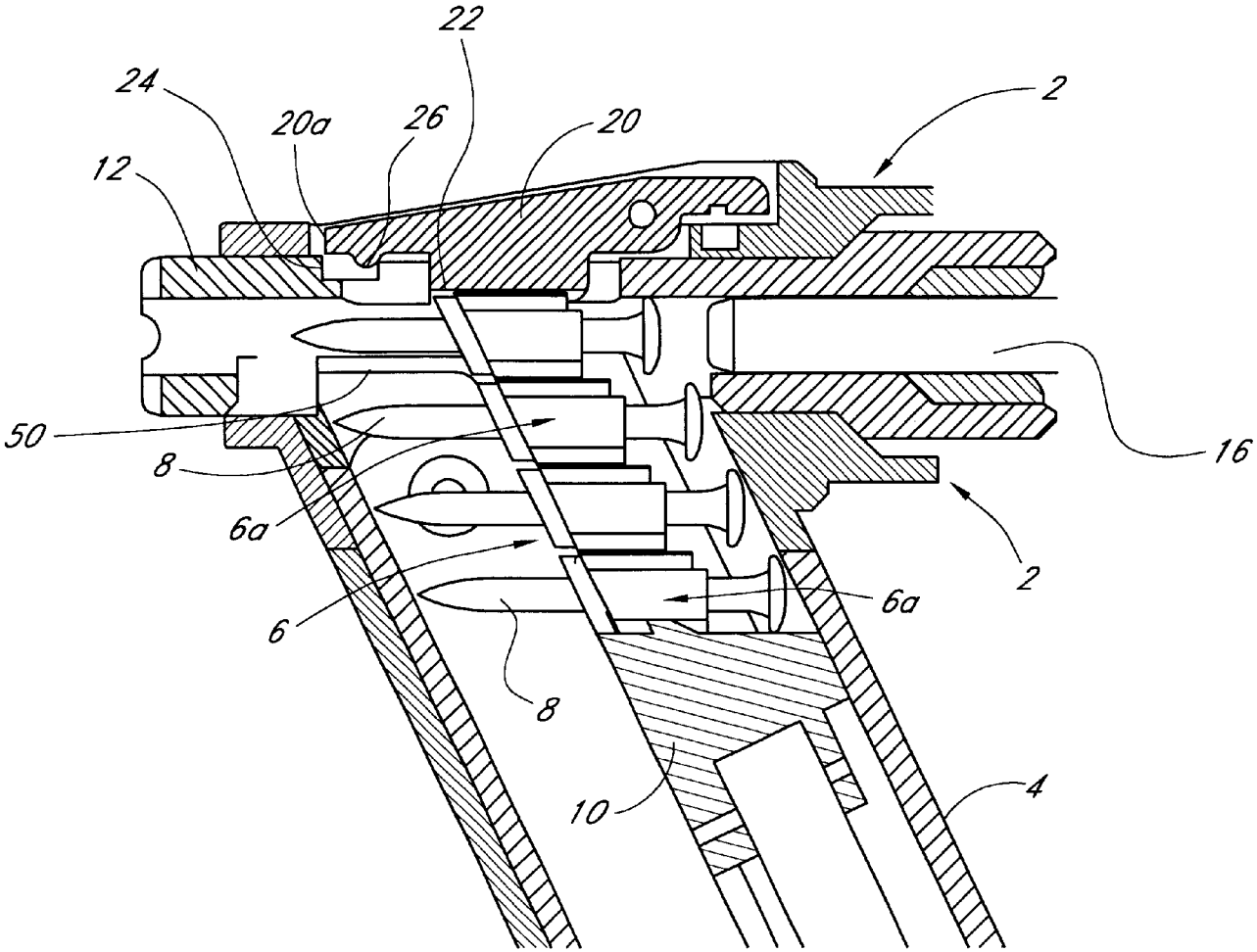
FIG. 1 is a schematic cross-section showing the forward end portion of an explosively actuated tool in accordance with a preferred embodiment of the invention and showing a magazine at the forward end of the body of the tool with a carrier strip feeding fasteners successively from the magazine into a fastener guide at the forward end of the tool.

With reference to the accompanying drawings, an explosively actuated tool of which only the front end portion and associated part of a fastener magazine is shown, comprises a body 2 carrying at its forward end a magazine 4 which receives a rectilinear carrier strip 6 carrying a series of fasteners 8 arranged in parallel. The carrier strip comprises a series of interconnected carrier segments 6*a* each of which carries a respective fastener 8, the carrier segment 6*a* at the leading end of the strip 6 being detached from the remainder of the strip during driving of the associated fastener. The magazine 4 includes a spring-actuated pusher member 10 which engages the trailing end of the carrier strip 6 so as to push the leading segment of the carrier strip and the fastener carried thereby into an axially displaceable fastener guide 12 mounted within the forward end of the body 2. The fastener guide 12 forms an extension of the barrel (not shown) of the tool. The fastener guide 12 and barrel receive a driving piston 16 the forward end of which is shown in the drawings and which, when the tool is fired, drives the fastener within the guide 12 into the substrate. This is a high energy process and the associated segment 6*a* of the carrier strip within the fastener guide 12 will be destroyed during this process. Cocking of the tool to permit firing occurs by pressing the forward end of the fastener guide 12 against the substrate thereby causing the fastener guide 12 to retract relative to the body 2 of the tool. The cocking and firing mechanism activated by retraction of the fastener guide or barrel extension is substantially conventional and will be well understood by those skilled in the art; it is therefore unnecessary for a description to be given of that system. What is important however is that the safety system provided by this mechanism is such that the tool cannot be actuated unless the forward end of the fastener guide 12 is pressed against the substrate so that it is held by the substrate in a retracted condition within the forward end of the body 2 and this safety requirement is fundamental in explosively actuated tools of this general type as will be well understood by those skilled in the art.

In the tool of the preferred embodiment, to facilitate manipulation of the tool the magazine 4 extends obliquely to the longitudinal axis of the tool so that the magazine 4 over most of its length is axially displaced from the front of the tool body 2 and hence, in use, is axially displaced from the substrate.

A spring-loaded safety latch 20 is mounted on the body 2 opposite the magazine 4.

The latch 20 has a cam or pad 22 projecting through a slot in the fastener guide 12 into the interior of the fastener guide. The latch 20 also has a locking nose 20*a* which, in its locking position (see FIG. 2), abuts against a step 24 formed in the outer surface of the fastener guide 12 with the fastener guide 12 in its extended position relative to the body 2.

Figure 3A:
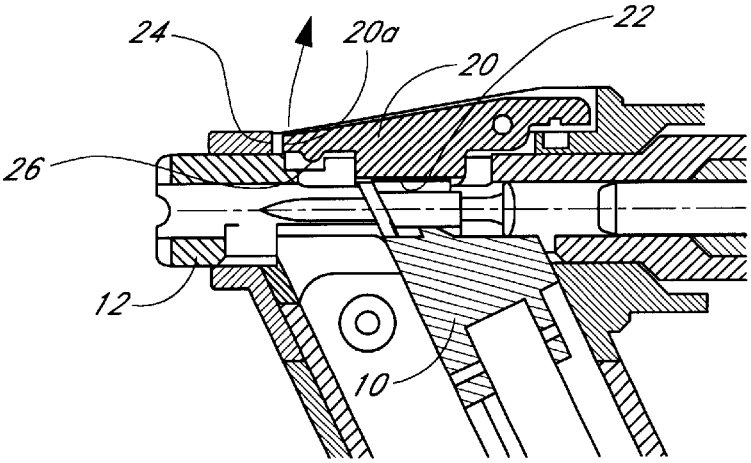
FIGS. 3*a* and 3*b* illustrate successive steps in the release of the safety latch into the presence of a fastener in the fastener guide.
Figure 3B:
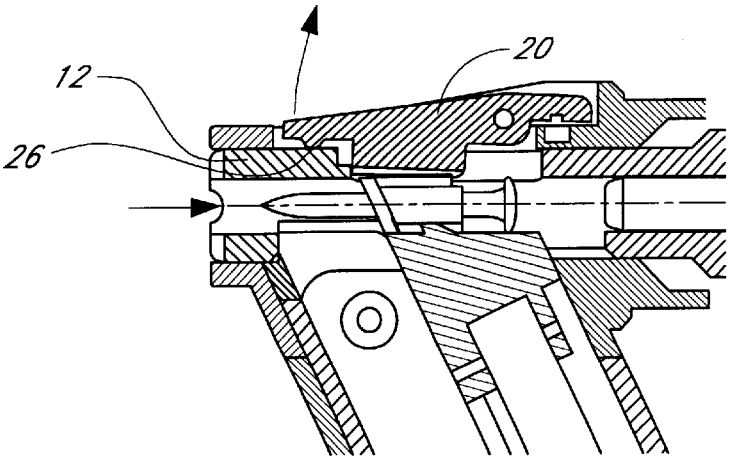

Accordingly when the latch 20 is in the locking condition it acts to prevent retraction of the fastener guide 12 when pressed against the substrate and hence prevents cocking and subsequent firing of the tool. The latch 20 is movable into a released position in which its locking nose 20*a* is moved out of the step 24 by reaction between the leading end of the carrier segment 6*a* within the guide 12 and the cam 22 which projects into the guide 12 (see FIGS. 1, 3*a* and 3*b*). More particularly, under the effect of the pressure exerted on the trailing end of the carrier strip 6 by the pusher member 10 within the magazine, the leading end of the carrier strip segment 6*a* within the fastener guide 12 will push the cam 22 to pivot the latch 20 out of locking engagement with the step 24 in the fastener guide. In this condition the fastener guide 12 is thus capable of retraction into the body 2 when pressed against the substrate to thereby enable actuation of the tool. It will be understood that this action can only occur if a carrier strip segment and fastener carried thereby is within the fastener guide and therefore it will be reliably ensured that when a strip of fasteners has been consumed no further actuation of the tool can take place until the magazine has been reloaded with a fresh carrier strip.

Although the interaction between the leading end of the carrier strip segment and the cam 22 can be made sufficient to displace the locking nose 20*a* out of the step 24 in the fastener guide 12, the inner surface of the cam 22 which reacts with the carrier strip segment may lie relatively close to the inner surface of the fastener guide 12 and may therefore be vulnerable to impact by the forward end of the piston 16 as it is driven through the fastener guide by the force of the explosive charge. Impact of the forward end of the piston 16 with the cam 22 would cause serious damage to the tool. In order to prevent this occurrence, the inner surface of the latch 20 has a second cam 26 inwardly of the locking nose 20*a*. Displacement of the latch 20 by co-operation with the leading end of the carrier strip segment positions the locking nose 20*a* out of the step 24 and radially beyond the outer surface of the fastener guide 12 sufficient to permit retraction of the fastener guide 12. However as the fastener guide 12 starts to retract when pressed against the substrate, the second cam 26 interacts with the outer surface of the fastener guide 12 to thereby further pivot the latch 20 outwardly so as to ensure that the main cam 22 is clearly withdrawn from the bore of the fastener guide 12 and is positively held in that withdrawn position by the co-operation between the second cam 26 and the outer surface of the fastener guide 12 when the fastener guide 12 is in its fully retracted position during firing of the tool (see FIG. 3*b*). Accordingly in this mode it is thereby ensured that the main cam 22 cannot interfere with operation of the driving piston. In an alternative arrangement a secondary cam for interaction with the latch 20 may be formed on the outer surface of the fastener guide to achieve a similar effect.

Figure 4:
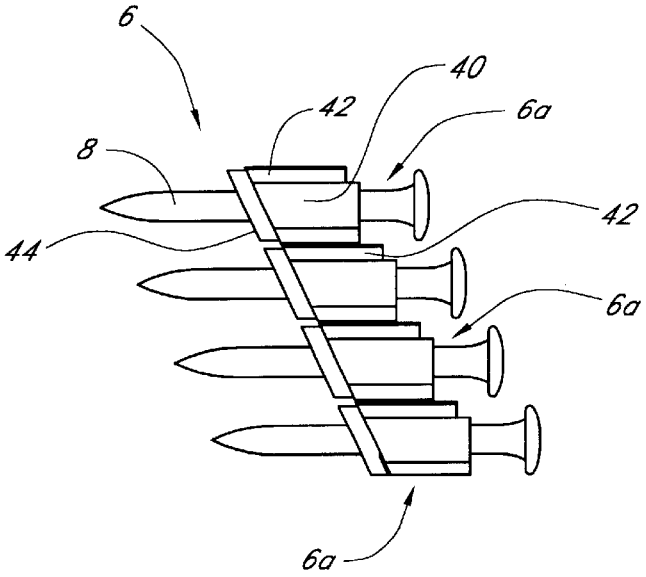
FIG. 4 is a side view of a carrier strip with fasteners.
Figure 5:
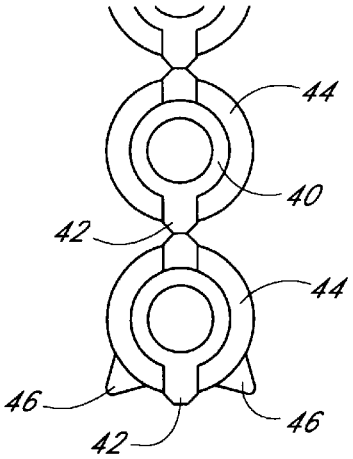
FIG. 5 is a rear view of the carrier strip and showing the carrier segments at the trailing end of the strip.

As shown in FIGS. 4 and 5, each segment 6*a* of the carrier strip 6 consists of a generally cylindrical body 40 through which the fastener 8 projects. Diametrically-opposed axial fins 42 project from the cylindrical body 40 and connect to the cylindrical bodies 40 of the following and trailing segments 6*a* of the carrier strip. Each of the axial fins 42 is grooved midway along its length to facilitate a separation of two adjacent segments in that zone when the leading carrier segment is within the fastener guide and the tool is actuated. At its forward end (in relation to the axial direction of the fastener 8), each segment 6*a* of the carrier strip is formed with an annular flange 44. The fastener 8 present within the bore of the fastener guide 12 preparatory to firing, is located in the guide by the interaction between the head of the fastener and inner surface of the guide, the interaction between the annular flange 44 of the associated segment 6*a* of the carrier strip and the inner surface of the guide, and the support provided for that segment of the carrier strip by the remaining segments of the carrier strip within the magazine and to which it is still attached at that point. The engagement of the main cam 22 of the pivotal latch 20 takes place initially at the forward end of the carrier segment, namely at the annular flange 44 and the immediately adjacent part of the fin 42 with the point of displacement travelling rearwardly along the fin 42 as the latch 20 is pivoted into its released position by the action of the carrier segment.

Figure 6:
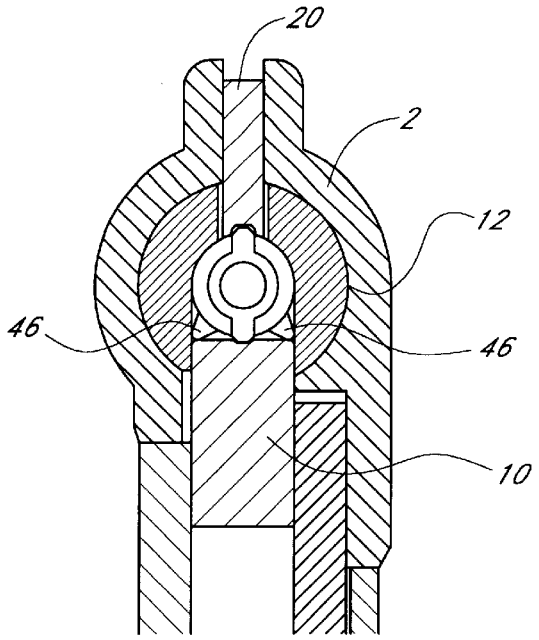
FIG. 6 is a section taken at right angles to the axis of the tool to show the manner in which the final carrier segment is located in the correct angular position within the fastener guide.
Figure 7A:
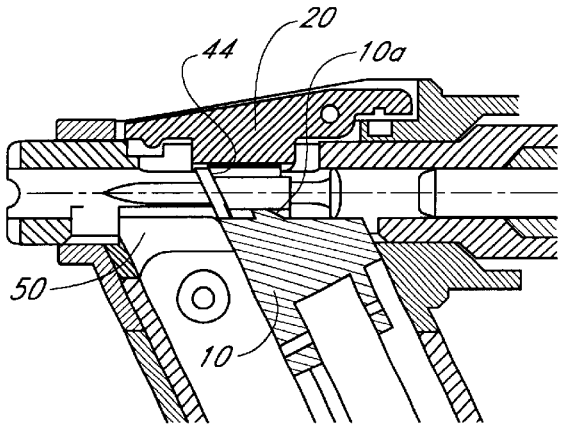
FIGS. 7*a* and 7*b* show the manner in which the final carrier segment is correctly axially located within the fastener guide.
Figure 7B:
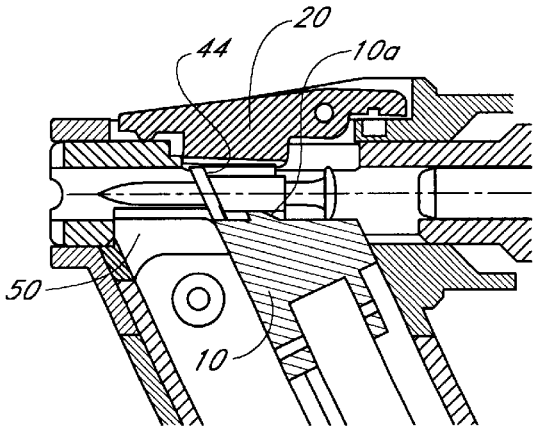
Figure 8:
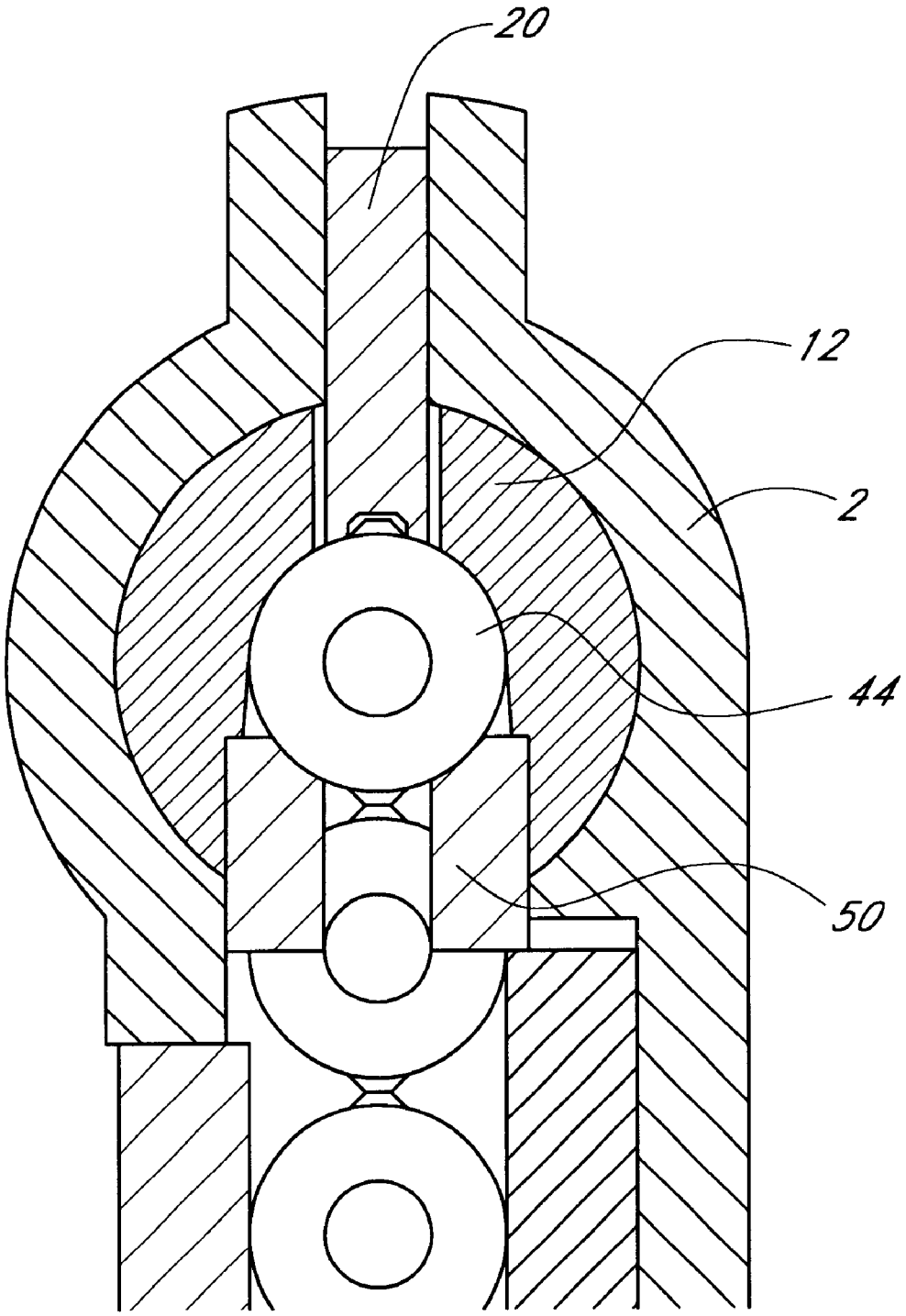
FIG. 8 is a section taken at right angles to the axis of the tool to show a guide within 30 the magazine adjacent the fastener guide and its co-operation with the carrier segments.

It is to be noted that when there are further carrier segments remaining within the magazine 4, the carrier segment within the fastener guide 12 will be accurately located by its attachment to those further remaining segments to enable the correct interaction with the pivotal latch 20 to ensure its release. However when the trailing-most (final) carrier segment and associated fastener is within the guide 12, other means are required to ensure the correct positioning of the segment within the fastener guide 12 for co-operation with the main cam 22 of the pivotal latch. In this regard it should be appreciated that although the final carrier segment will be advanced into the fastener guide 12 in the correct position and orientation, the tool might not necessarily be used immediately, and, during the ensuing period prior to use, the tool may be subject to various types of rough handling, for example the tool may be subject to vibration and shaking on the floor of a vehicle, and unless other measures are taken to maintain correct alignment the carrier segment and associated fastener may displace both rotationally and axially within the fastener guide 12 so that it is no longer in the correct position for co-operation with the cam 22. In the preferred embodiment this is achieved by forming at the trailing end of the annular flange 44 of the final segment of the strip a pair of radially-extending lugs 46 one at each side of the fin 42. The lugs 46 interact with the surface of the pusher member 10 (see FIG. 6) to provide a stable support for the carrier segment so as to prevent rotation thereof. Also, the pusher member 10 has on its outer surface a small axial abutment 10*a* (see FIGS. 7*a* and 7*b*) which is engageable by the rear surface of the annular flange 44 of the segment so as to restrict rearwards axial movement of the segment. Although a limited amount of axial movement is permitted (as may be seen by a comparison of FIGS. 7*a* and 7*b*), the extent of the permitted movement is such that the carrier segment is still in an axial position in which it can effectively cooperate with the cam 22 of the pivotal latch 20. Forwards axial movement of the segment is restricted by abutment of the forward surface of the annular flange 44 against the rear edge of a guide element 50 carried by the magazine 4 adjacent the entry to the fastener guide 12 (see in particular FIG. 7*b*). The guide element 50 has a part-cylindrical inner surface which matches that of the fastener guide 12 and is appropriately slotted (see FIG. 8) to permit passage of the forward end of the fastener 8 into the fastener guide 12.

The rear edge of the guide element 50 also assumes a role during the firing of the tool in that it supports the carrier segment within the fastener guide 12 relative to the remainder of the carrier strip as the fastener is being driven forward by the action of the piston 16 and that carrier segment becomes sheared from the following segments. As the fastener is driven forwardly within the fastener guide 12 the inner surface of this guide element 50 also performs a guiding function in conjunction with the head of the fastener as it is advanced through the fastener guide into the substrate.

Although in the embodiment particularly described the carrier segment at the trailing end of the carrier strip is correctly located within the fastener guide by the use of the two radially-projecting lugs 46 and by the co-operation between its annular flange 44 the pusher member 10 and the guide 50, the final carrier segment can incorporate alternative means which act to stabilise the position of that segment within the fastener guide to ensure correct co-operation with the pivotal latch 20. However one particular advantage of using the two radially-projecting lugs 46 is that they provide both a visual and tactile indication as to the correct orientation of the carrier strip within the magazine so as to ensure that the strip is inserted with the lugs at the trailing end rather than at the leading end with respect to the magazine. If alternative means are used for ensuring stabilisation of the final carrier segment within the fastener guide, steps may need to be taken to ensure that the correct direction of insertion of the carrier strip into the magazine is immediately discernible to an operator.

Figure 2:
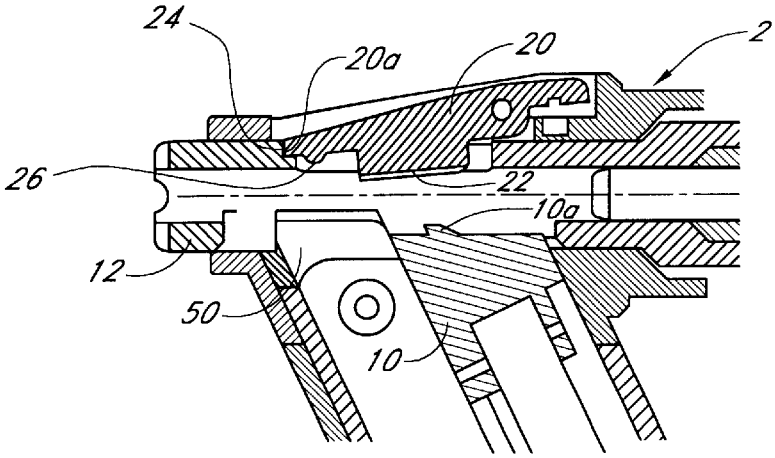
FIG. 2 is a section similar to FIG. 1, but showing operation of a safety latch to prevent firing of the tool in the absence of a fastener within the fastener guide.

In practice, the magazine also includes a cover 60 (FIGS. 9 and 10) which can be opened to permit loading of a fresh carrier strip 6 with fasteners 8. In use of the tool after loading of a fresh carrier strip 6, the cover 60 is closed so that substantial parts of the structure illustrated in FIGS. 1 to 3 are enclosed and protected within the cover 60. In the preferred embodiment of the invention, the magazine also includes means visible by an operator when the cover 60 is closed to indicate the number of fasteners 8 remaining for use on the carrier strip 6. In this respect, even although the interlock system previously described ensures that the tool cannot be fired when there are no fasteners present, nevertheless for the convenience of the operator it is still desirable to know how many fasteners are remaining within the tool without the necessity of opening the cover 60.

Figure 9:
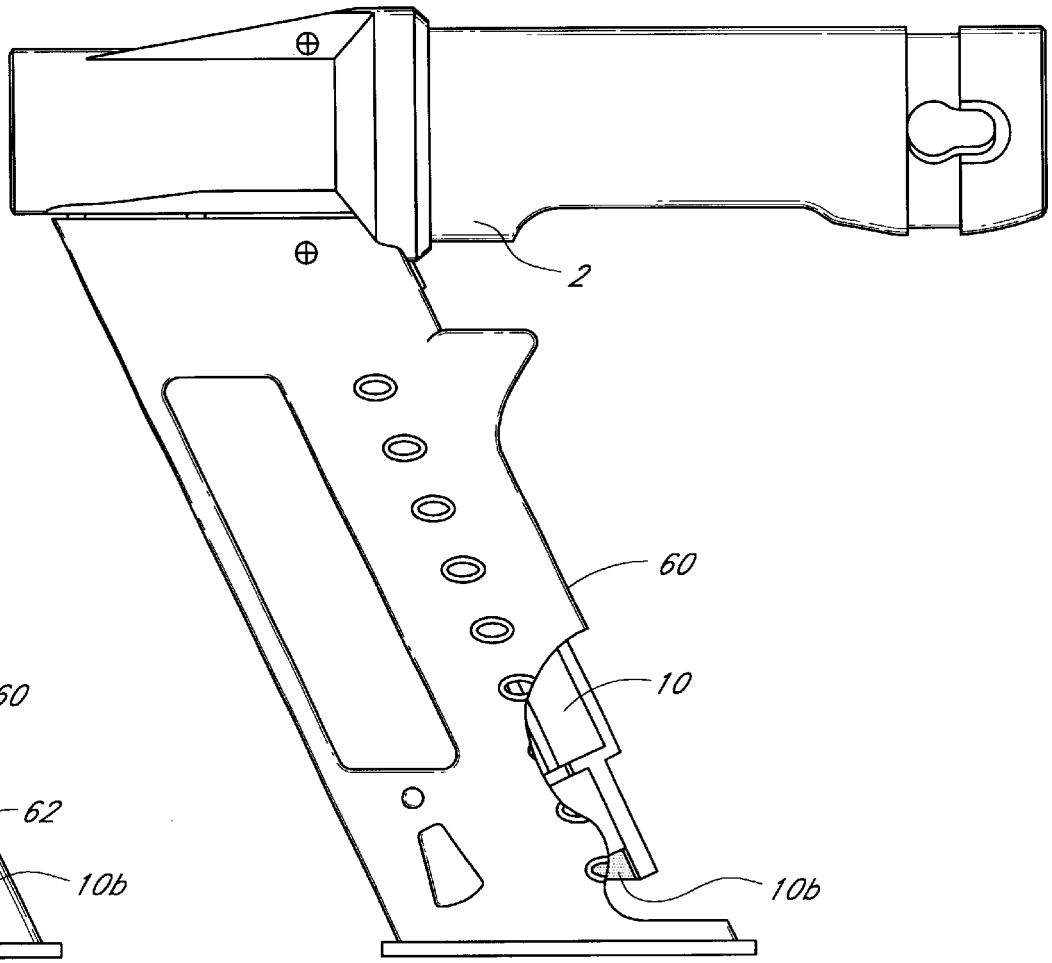
FIG. 9 is a partially cut-away view showing the magazine with a cover in a closed position.
Figure 10:
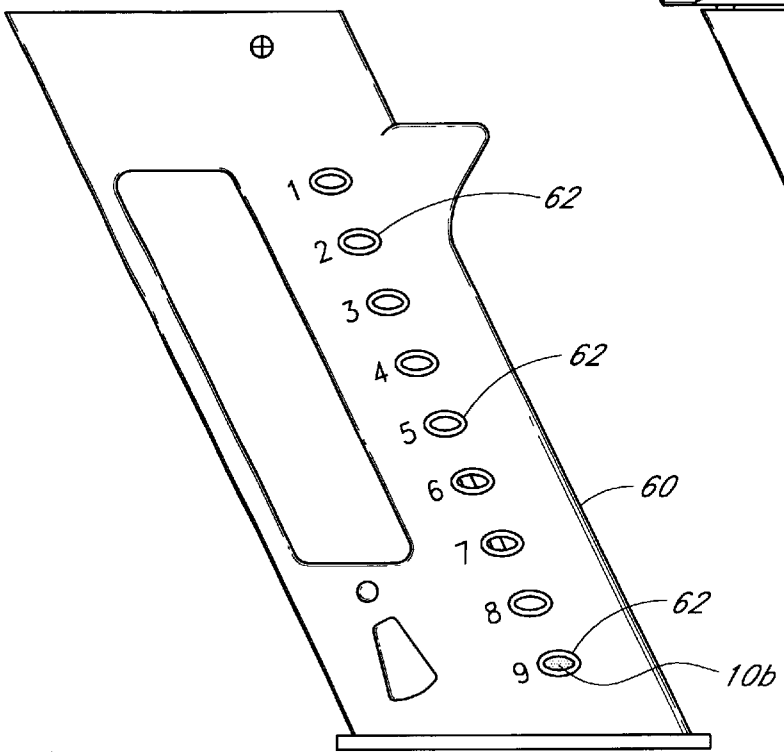
FIG. 10 shows the cover of FIG. 9 and indicates the manner in which the number of fasteners within the tool may be viewed through the cover.

FIG. 9 shows the magazine with the cover 60 in its closed condition in which it encloses the components shown in FIGS. 1 to 3. Preferably the cover 60 is mounted for sliding movement along the axis of the magazine between its closed position as shown in FIG. 9 in which its upper end is adjacent to the body 2 of the tool and a lower position in which its upper end has moved downwardly along the magazine to facilitate loading of the magazine with a fresh carrier strip. The cover 60 includes a series of apertures 62 regularly spaced along the axis of the magazine. An appropriately coloured part 10*b* of the pusher member 10 is visible through respective ones of these apertures 62 as the pusher member 10 advances upwardly through the magazine as the fasteners are sequentially fired. The apertures are appropriately numbered so that an operator, by observing in which numbered apertures 62 is visible the coloured part 10b of the pusher member, will readily ascertain the number of fasteners remaining within the tool.

The embodiment has been described by way of example and modifications are possible within the scope of the invention.

What is claimed is:

1. A power actuated tool for driving a fastener such as a pin or nail into a substrate, said tool comprising:

a body;

a fastener guide mounted at a forward end of the body, a driving piston actuable on firing of the tool to drive a fastener within the fastener guide into the substrate, said fastener guide being displaceable axially inwardly relative to the body when the forward end of the tool is pressed against a substrate whereby to permit firing of the tool;

a magazine carried by the tool for containing a plurality of fasteners mounted seriatim on segments of a carrier strip, said magazine including an advancing system for advancing a leading end of the carrier strip and the fastener carried thereby into the fastener guide; and a releasable locking system for impeding firing of the tool, said locking system being releasable in response to the presence of a fastener and associated segment of the carrier strip within the fastener guide whereby to permit firing of the tool only when a fastener is present within the fastener guide, wherein the locking system comprises a pivotal latching lever pivotally mounted to the body and interposed between the body and the fastener guide, wherein the latching lever extends forwardly to engage with the fastener guide in a latching condition of the latching lever, wherein the latching lever is spring biased into the latching condition in which the lever interacts between the body and fastener guide to prevent inwards axial displacement of the fastener guide relative to the body, a portion of said latching lever projecting inwardly into the fastener guide, said portion being displaced by the presence of a fastener in said fastener guide so as to cause the latching lever to pivot to an unlatching condition to thereby allow inwards axial displacement of the fastener guide relative to the body to permit firing of the tool, such inwards axial displacement of the fastener guide causing further pivotal movement of the latching lever to move said portion of the lever into a position in which contact of said position by a head of the fastener and driving piston of the tool is prevented when the tool is fired, and wherein said lever has at a forward end portion a cam portion engageable with the fastener guide in the unlatching condition such that inwards axial displacement of the fastener guide engages the cam portion to pivot the latching lever clear of the interior of the fastener guide.

2. The power actuated tool according to claim 1, wherein said tool further comprises:

a cover movable from a closed to an open condition to permit loading of a fresh carrier strip with fasteners into the magazine; and an indicating system for providing an indication of the number of fasteners remaining in the tool, said indication being observable by an operator when the cover is in its closed condition.

3. The power actuated tool according to claim 2, wherein indication of the number of fasteners remaining is effected by viewing from outside of the tool with the cover closed, the position of the advancing system within the magazine.

4. The power actuated tool according to claim 3, wherein the advancing system comprises a pusher member which engages the final carrier segment at the trailing end of the carrier strip so as to advance the leading end of the carrier strip into the fastener guide, the pusher member advancing stepwise through the magazine as each successive fastener is fired whereby the position of the pusher member within the magazine is indicative of the number of fasteners remaining in the tool.

5. The power actuated tool according to claim 4, wherein the position of the pusher member within the magazine is effected by viewing a segment of the pusher member through an aperture in the cover.

6. The power actuated tool according to claim 4, wherein the cover includes an aperture to enable viewing of the position of the final carrier segment at the trailing end of the carrier strip.

7. A power actuated tool according to claim 1, wherein said inwardly projecting portion of said latching lever is engageable by a part of the carrier strip segment carrying the fastener within the fastener guide.

8. A power actuated to according to claim 1, wherein the advancing system of said magazine comprises a pusher member which engages the final carrier segment at the trailing end of the carrier strip so as to advance the leading end of the carrier strip into the fastener guide, said pusher member being subject to a spring bias the force of which is transmitted via the carrier strip to displace the pivotal latching lever into its unlatching condition.

* * * * *